United States Patent [19]

Takeda et al.

[11] Patent Number: 5,061,092

[45] Date of Patent: Oct. 29, 1991

[54] MULTICOLOR THERMAL PRINTER RECORDING MEDIUM TRANSMISSION MECHANISM

[75] Inventors: Fumio Takeda, Ushiku; Takashi Yoshida, Ibaraki; Hideki Tanaka, Tsuchiura; Yoshikazu Ishitsuka, Ibaraki; Tsutomu Omine, Mito; Masao Miyasaka, Mito; Mitsugu Asano, Higashiibaraki; Akira Igarashi; Hiroshi Takahagi, both of Katsuta, all of Japan

[73] Assignees: Hitachi, Ltd.; Hitachi Koki Co., Ltd., both of Tokyo, Japan

[21] Appl. No.: 541,023

[22] Filed: Jun. 20, 1990

[30] Foreign Application Priority Data

| | | | |
|---|---|---|---|
| Jun. 26, 1989 | [JP] | Japan | 1-160758 |
| Aug. 25, 1989 | [JP] | Japan | 1-219579 |
| Nov. 24, 1989 | [JP] | Japan | 1-305042 |

[51] Int. Cl.[5] ..... B41J 3/02

[52] U.S. Cl. ..... 400/120; 400/240.4; 400/635; 400/708

[58] Field of Search ..... 400/120, 223, 225, 240, 400/240.4, 624, 634, 635, 708, 708.1, 629, 569, 616.2; 271/198, 902, 7, 34

[56] References Cited

U.S. PATENT DOCUMENTS

| | | | |
|---|---|---|---|
| 2,242,268 | 4/1941 | Sherman | 400/635 |
| 2,282,411 | 5/1942 | Sunderstrand | 400/635 |
| 4,109,779 | 8/1978 | Bauer et al. | 400/635 |

FOREIGN PATENT DOCUMENTS

| | | | |
|---|---|---|---|
| 0174047 | 3/1986 | European Pat. Off. | 400/240.4 |
| 0011261 | 1/1984 | Japan | 400/240.4 |
| 0135269 | 6/1988 | Japan | 400/569 |

OTHER PUBLICATIONS

"Edge-Restraint Mechanism for Sheet-Transporting Device", IBM Tech. Discl. Bulletin, vol. 23, No. 7A, 12/80, pp. 2686-2687.

*Primary Examiner*—Eugene H. Eickholt

*Attorney, Agent, or Firm*—Antonelli, Terry, Stout & Kraus

[57] ABSTRACT

A thermal printer wherein a sheet of recording paper is interposed between two drums provided on axially opposite sides of a shaft of a platen roll facing a line-type thermal head and an endless belt mounted on outer peripheries of the drum. One way clutches provided on a shaft of the drum will cause the paper to rotate together with the drums during recording and the recording paper is driven by the endless belt during paper feed and delivery operations to slide relative to the drums. The sheet of paper is fed to a lower portion of an open portion of the drums and is removed from an upper portion of the open portion of the drums so that the feed and delivery of the sheet of paper can be effected upon rotation of the drums in one direction, and the printing operation is started after a detection of a trailing end of the sheet of paper so that the printing operation can be reformed regardless of the length of the sheet of paper immediately after the feed of the sheet of paper.

14 Claims, 5 Drawing Sheets

MULTICOLOR THERMAL PRINTER RECORDING MEDIUM TRANSMISSION MECHANISM

BACKGROUND OF THE INVENTION

The present invention relates to a thermal printer, and more particularly, to the improvement of a transmission mechanism for driving a recording medium winding/feeding rotary body, including a platen roll shaft and a drum shaft, in a thermal printer in which recording is conducted on a sheet of recording paper by placing inks of a plurality of colors on top of another on the recording paper during the rotation of the recording paper in one direction.

In conventional thermal printers of the type having a platen roll on which recording is conducted, which are disclosed by, for example, Japanese Patent Unexamined Publication No. 60-63178, a recording period is determined by detecting the rotation of a motor for driving the platen roll by a counter. More specifically, in case the motor is a DC motor, the rotational angle of a motor for driving the platen roll is detected by an encoder or a frequency generator (FG), and a frequency corresponding to the recording period or a number of signals from the encoder corresponding to the recording period is counted by the counter. A control circuit performs recording upon receipt of a signal from the counter.

In case the motor for driving the platen roll is a pulse motor, a number of motor driving pulses are counted by a counter, and the counter sends a signal to the control circuit once it counts the number of pulses corresponding to the recording period, by which the control circuit performs recording, as in the case of the DC motor.

In the thermal printer of the type described above, no consideration is given to transmission errors of a transmission gear train for driving a platen roll shaft or a drum shaft. That is, when recording is conducted by rotating a sheet or recording paper in one direction and placing inks of a plurality of inks one upon another on the paper each gear in the gear train rotates through an arbitrary angle in a single color recording period, so that irregular feeding caused by the transmission errors in the recording period of one color does not coincide with that caused in the recording period of another color, and misalignment of dots of a plurality of colors occurs, thus generating uneveness of color.

This problem may be solved by absolutely improving the transmission accuracy of the gears. However, in the case the gear train includes a large number of gears, accuracy control of individual gears (including pitch accuracy, tooth shape accuracy and tooth trace accuracy in a widthwise direction of gears in, for example, JIS1) does not assure suppression of variations in the transmission errors and uneveness of colors.

The applicants of this invention disclosed a thermal printer in U.S. Pat. application No. 353,695 or West German Pat. application No. 3,915,598.7. This thermal printer includes a platen roll disposed in opposed relation to a line-type thermal head, two drums located on the axially opposite sides of the platen roll, a plurality of pulleys for each drum provided in the circumferential direction of the drum at predetermined intervals and two rotatably supported pulley holders for supporting the pullup and located on the axially opposite side of the drum, and an endless belt for each drum, adapted to be guided by the pulleys such that the inner side of the belt is in close contact with the outer periphery of the drum except for a portion of the drum (hereinafter referred to as an open portion). In such a thermal printer, a sheet of paper is first wound around the drum with the two lateral edges of the paper caught between the drums and the belts, and the sheet of paper is then rotated in one direction in that state by rotating the drums together with the pulley holders, during which recording is conducted by pressing an ink ribbon and the paper against the platen roll by the thermal head and by heating the thermal head to melt or sublimate the ink ribbon.

The above-described thermal printer has an advantage in that a high quality color printing, which has no misalignment of colors, can be conducted because a sheet of paper is not moved in a reciprocating manner during the printing. During a paper feed operation in which a sheet of paper is wound around the drums and a paper delivery operation in which a sheet of paper is taken off from the drums, only the drums are rotated and the paper is fed or taken off by means of the drums and the belts which are rotatingly driven by the drums. However, the above-described thermal printer suffers from the following problems. Firstly, since a sheet of paper is fed to and taken off from above the open portion of the drums, direction of the rotation of the drums during the paper feed and delivery operations must be reversed. In consequence, in case a sheet of paper is slantwise wound around the drums during the paper feed operation, direction of the rotation of the drums must be reversed in order to take off the paper, making recovery operation difficult. Secondly, in the above thermal printer, a sensor, e.g., a reflection type sensor, for detecting the forward end of the paper is provided in the vicinity of the paper feed port of the drums, and the paper feed operation is switched over to the printing operation after a period of time required for the longest sheet of paper that can be printed to be wound around the drums after the sensor detects the forward end of the paper. Accordingly, in the case of a short sheet of paper, staring of the printing operation is inefficiently delayed. That is, printing speed is reduced. Also, in case printing starts after a period of time corresponding to the length of the paper has elapsed, a sensor for detecting the length of the paper is required and a complicated circuit configuration or an operation depending upon the length of the paper is required, deteriorating the operability. Thirdly, switch-over between the rotation of only the drums during the paper feed and delivery operations and the rotation of the drums and the pulley holders as one unit during the printing is conducted by axially sliding a gear. However, when the gear is caused to slide, it cannot be brought into mesh with another gear smoothly, and this makes automatic selection difficult. Hence, sliding of the gear is operated manually, and this deteriorates operability and reduces printing speed. Fourthly, during the printing, the thermal head is pressed against the elastic platen roll under that pressure which allows the platen roll to slightly undergo deformation. However, since the platen roll is mounted to make the outer peripheral surface thereof in alignment with the outer peripheral surface of each of the drums, the paper will be folded at the opposite ends of the platen roll when the thermal head is pressed against the platen roll. As a result, folding of the paper may occur, adversely affecting paper feeding and printing quality.

SUMMARY OF THE INVENTION

An object of the present invention is to solve the aforementioned problems of the above prior art.

Another object of the present invention is to provide a thermal printer which is free from mis-alignment of a plurality of colors, i.e., unevenness of colors, in a recording which is conducted by rotating a recording medium in one direction and placing inks of the plurality of colors one on another.

Another object of the present invention is to provide a thermal printer and a printing method in the thermal printer which improve operability and printing speed.

In order to achieve the above-described objects, the present invention provides a thermal printer comprising a platen roll axially extending in opposed relation to a line-type thermal head, two drums provided on the axially opposite ends of the platen roll, at least one of which is driven by a motor, two pulley holders provided axially outwardly of the drums, a plurality of belt supporting pulleys provided in the circumferential direction of the drum at predetermined intervals and supported on pulley shafts mounted on the pulley holder, and endless belt means, adapted to be guided by the pulleys such that the inner side of such belt means is in close contact with a portion of the outer periphery of the drum, the drums being rotated and the belt means being rotatingly driven during the paper feed operation to cause a sheet of paper to be inserted between the drums and the belt means, thereby holding the opposite edges of the paper therebetween, the drums and the pulley holders being rotated together to move the paper in one direction during the printing operation to allow the platen roll and the thermal head to conduct printing during the printing operation, and wherein the pulley holders are mounted on drum shafts through one-way clutches which act to change the rotational direction of the motor during the paper feed and delivery operations and during the printing operation such that only the drums are rotated during the paper feed and delivery operations and the drums and the pulley holders are rotated together during the printing operation.

The present invention also provides a thermal printer which includes a thermal head, a recording medium winding/feeding rotary body, a motor for driving the recording medium winding/feeding rotary body, and a driving force transmission mechanism, and wherein an ink film and a recording medium overlaps each other and pass between said thermal head and said rotary body so that printing is conducted by means of ink having a plurality of colors upon the rotation of said rotary body in one direction and wherein said driving force transmission mechanism is constituted by a train of gears such that a velocity ratio between the rotational shaft of said rotary body and the shaft of said motor are set so as to cause the shafts to rotate integral numbers of times during a recording period of one color and teeth of transmission gears provided between the motor shaft and the rotary body are set so as to cause the gears to rotate integral numbers of times during a recording period of one color.

DESCRIPTION OF THE PREFERRED EMBODIMENTS

Figure 1:
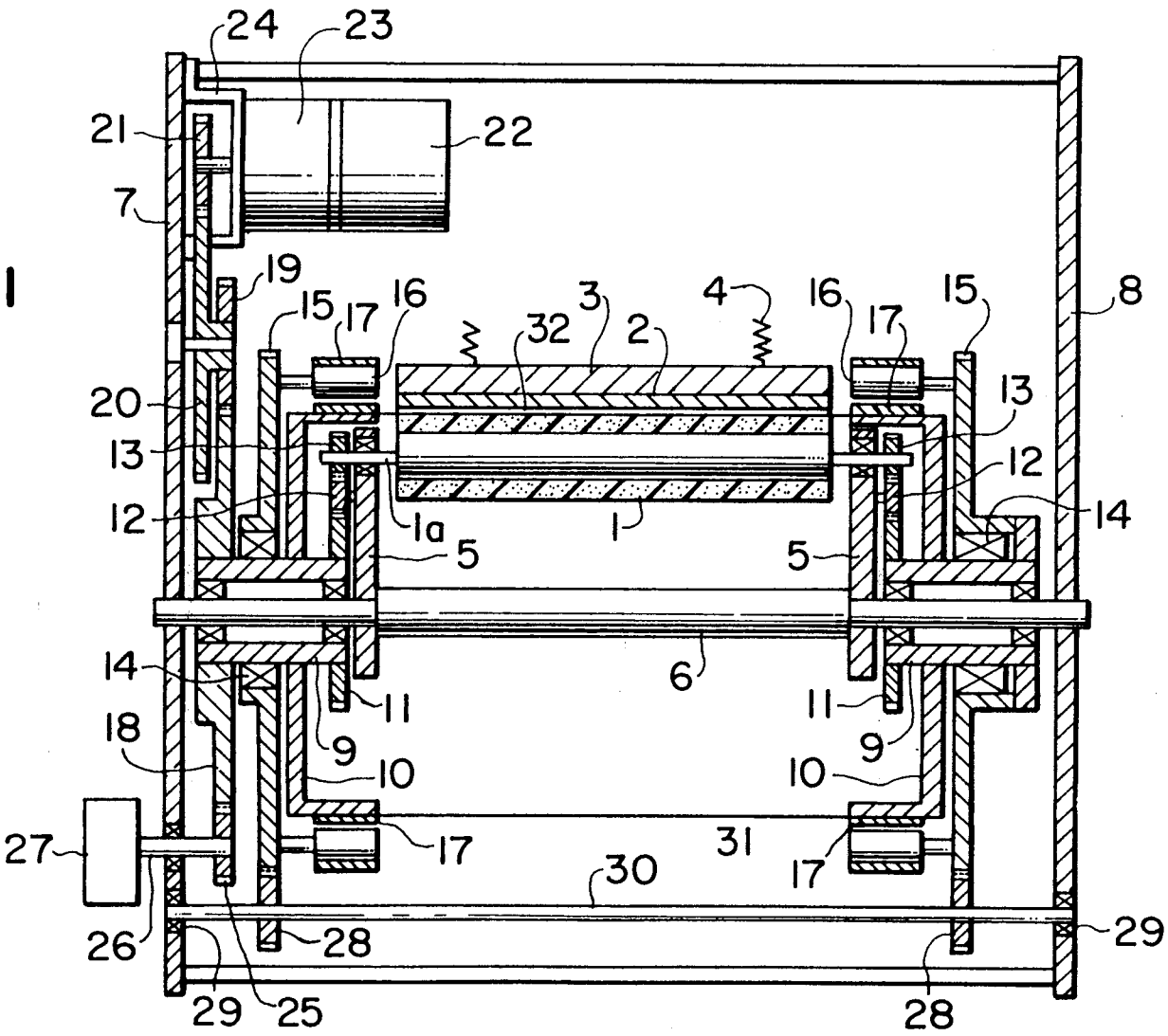
FIG. 1 is a cross-sectional view of a thermal printer according to a first embodiment of the present invention.

A first embodiment of the present invention will be described first with reference to FIGS. 1 to 3. A thermal printer shown in FIGS. 1 to 3 includes a platen roll 1 which forms a recording medium winding rotary body, a line-type thermal head 2 disposed in a facing relationship with the platen roll 1, a head holder 3 for securing thereto the thermal head 2, a spring 4 for biasing the thermal head 2, a pair of roll holders 5 for rotatably supporting the platen roll 1, a stationary shaft 6 extending in parallel to the platen roll 1 and securedly supporting the roll holder 5, a pair of frames 7 and 8 for supporting the stationary shaft 6, a pair of cylindrical shafts 9 rotatably supported on the opposite ends of the stationary shaft 6 through bearings, a pair of drums 10 provided axially outwardly of the platen roll 1 to be fixed to the cylindrical shafts 9 and to constitute the recording medium winding rotary body, a pair of pulley holders 15 supported on the cylindrical shafts 9 through one-way clutches 14, a plurality of pulleys 16 rotatably supported on the outer peripheral portions of the pulley holders, endless belts 17 wound around the outer peripheries of the drums by means of the pulleys, a pulse motor 22 for rotating the recording medium winding rotary body through a train of gears, a rotary encoder 27 which serves as a rotational angle detector, and an automatic paper feed and delivery mechanism.

The thermal head 2 is of the retracting type such that it is separated from the surface of the platen roll 1 to release pressing when a sheet of recording paper 31 is fed or taken off or when an ink film 32 of each color is to be positioned.

The recording medium winding rotary body is constituted by the platen roll 1 and the pair of drums 10. The outer peripheral surface of each drum 10 is slightly lower than the outer peripheral surface of the platen roll 1 by, for example, about 0.2 mm. The outer peripheral length of each drum 10 is longer than the length of the longest recording paper 31 that can be used. The platen roll 1 is adapted to rotate in the same direction at the same peripheral speed as that in which the drums 10 are rotated and by means of gears 11 fixed to the cylindrical shafts 9, gears 12 rotatably supported on the roll holders 5 and gears 13 fixed to a shaft la of the platen roll 1.

Figure 2:
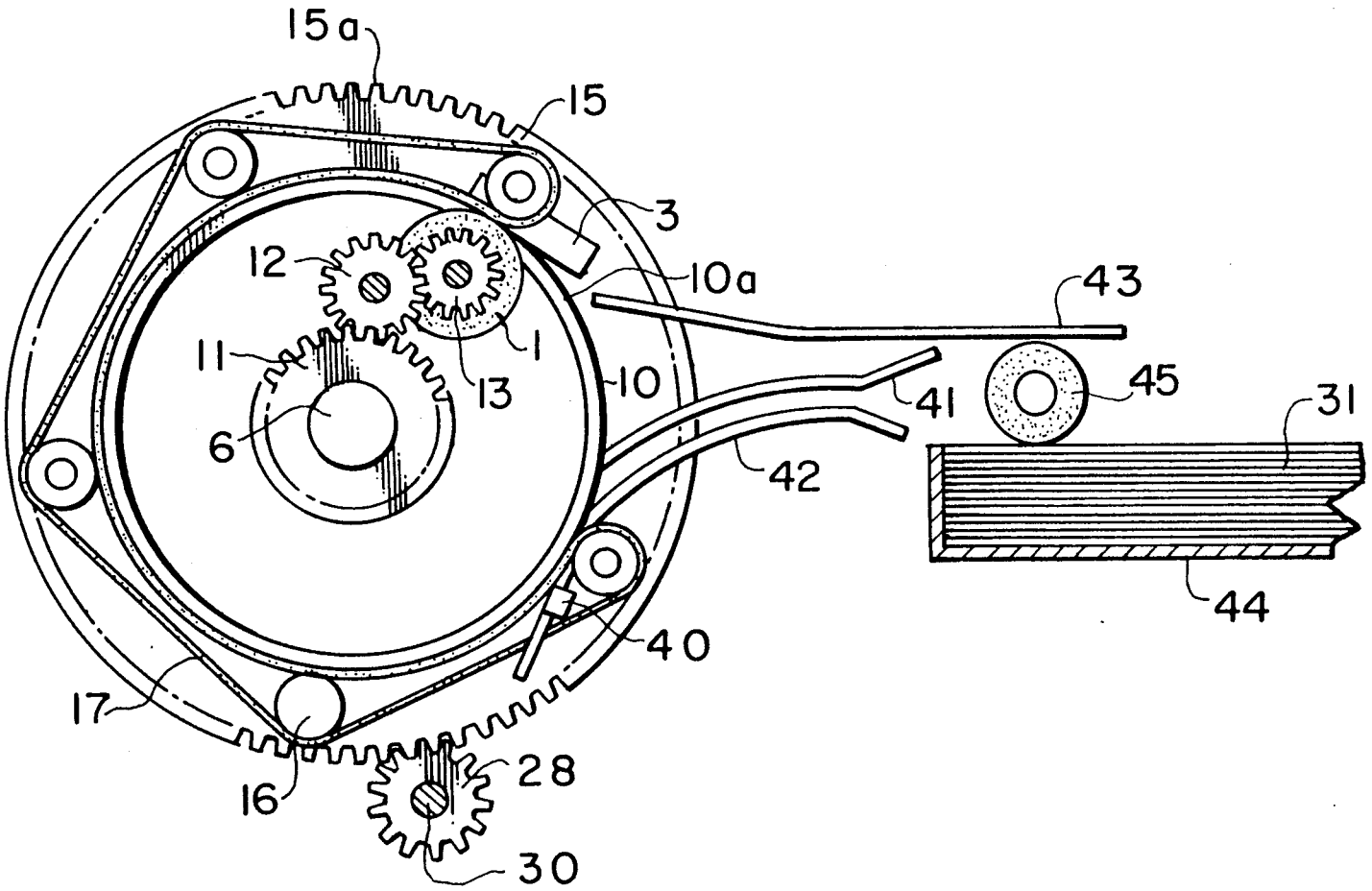
FIG. 2 illustrates a positional relationship between a drum and associated components during the paper feed and delivery operations.

The one-way clutches 14 are constructed such that they transmit rotation of the cylindrical shafts 9 to the pulley holders 15 only when the drums 10 are rotated counterclockwise as viewed in FIG. 2 during the recording, and that they idle not to transmit rotation of the cylindrical shafts 9 to the pulley holders 15 when the drums 10 are rotated clockwise as viewed in FIG. 2 for supplying or discharging the recording paper. Each of the pulley holders 15 is provided at its outer peripheral portion with teeth 15*a* (see FIG. 2) which is adapted to mesh with each of a pair of gears 28 fixed to a shaft 30 which in turn is supported by the frames 7 and 8 through one-way clutches 29, so that the rotations of the right and left pulley holders 15 are prevented from differing in phase.

Figure 3:
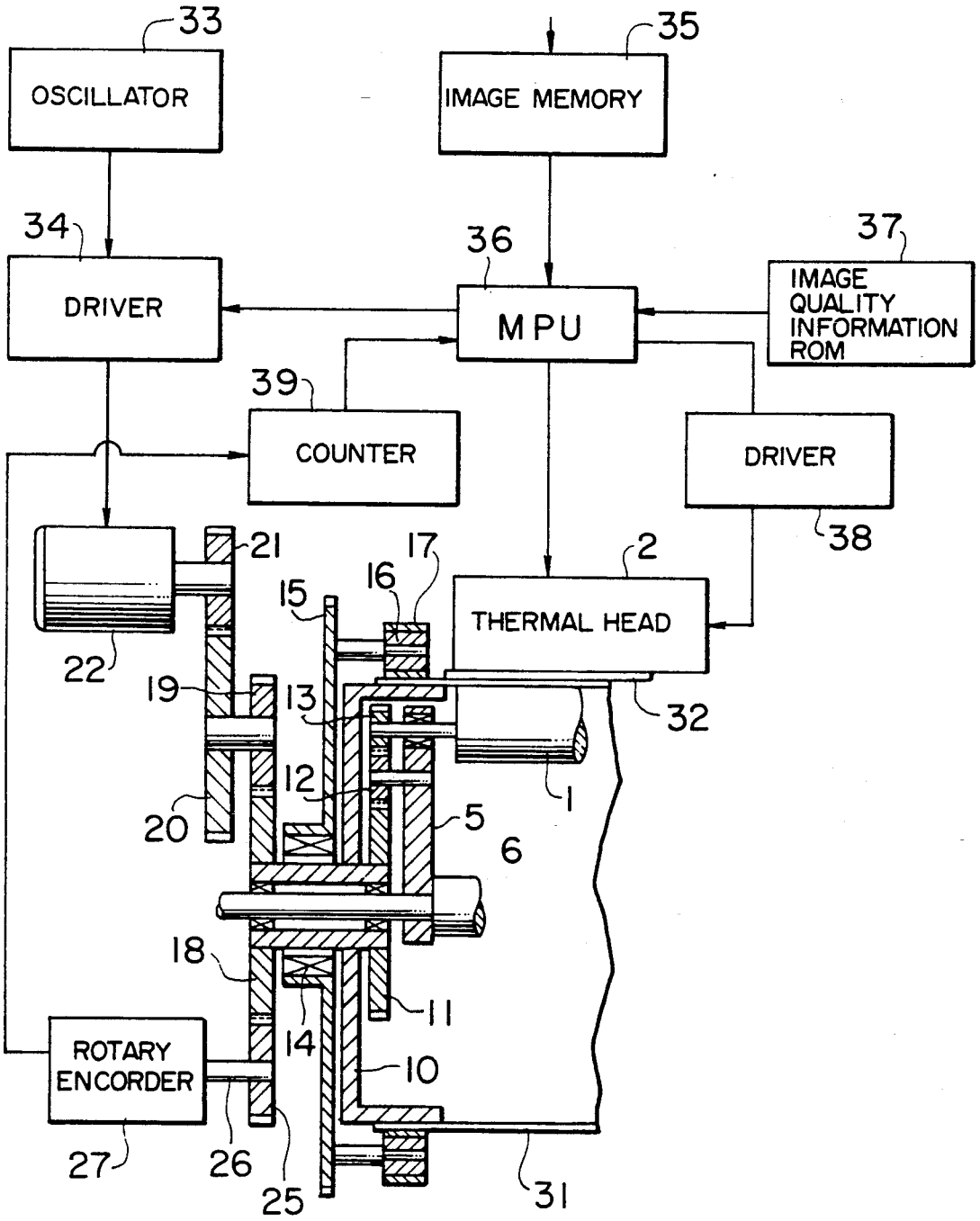
FIG. 3 is a block diagram showing a recording sequence.

The pulse motor 22 is driven by an oscillator 33 through a driver 34, as shown in FIG. 3. Also, the pulse motor 22 is coupled to a gear box 23 which is fixed to the frame 7 through a bracket 24. A gear 21 fixed to an output shaft of the gear box 23 is in mesh with a gear 20 rotatably supported on the frame 7. A gear 19 coaxially fixed to the gear 20 is in mesh with a gear 18 fixed to the cylindrical shaft 9, and the gear 18 is in mesh with a gear 25 fixed to one end of a shaft 26 rotatably fixed to the frame 7. The other end of the shaft 26 mounts a rotary encoder 27.

Now, the number of teeth of each gear in the gear train employed in the first embodiment as well as the number of revolution thereof in a single color recording period will be described. The number of teeth of the gear 18 is 112, the number of teeth of gear 25 is 28, the number of teeth of the gear 11 is 90, the number of teeth of the gear 12 is 30, the number of teeth of the gear 13 is 18. The diameter of the platen roll 1 is 34 $\phi$, and the diameter of each of the drums 10 is 170 $\phi$. In the recording period for a single color, the drum 10 makes one revolution, the platen roll 15 makes five revolutions, the gear 12 makes three revolutions, and gear 25 makes four revolutions. Thus, each gear makes an integral number of revolutions in the recording period, so that unevenness of feeding caused by the transmission errors exhibits reproducibility.

The automatic paper feed and delivery mechanism includes a paper feed guide consisting of a pair of upper guide 41 and a lower guide 42, a paper delivery guide 43, a pick-up roll 45, a paper cassette 44, and two sensors 40 provided in the vicinity of the axially opposite ends of the lower guide 42. The paper feed guides 41 and 42, the paper delivery guide 43, and the paper cassette 44 are fixed to a supporting frame (not shown). The pickup roll 45 is rotated by an appropriate driving device to feed out sheets of recording paper 31 accommodated in the paper cassette 44 toward the paper feed guides 41 and 42. The sensor 40 may be a reflecting type optical sensor and act to detect the presence or absence of the sheet of recording paper 31 retained on the drums 10 to output a logical value 1 or 0. The leading or trailing end of the recording paper 31 can be detected by detecting variations in the output signal from the sensors 40.

More specifically, it is possible to detect the rear end of the recording paper 31 being wound around the drums 10 when the recording paper 31 is fed to the drums 10. Upon detection of the trailing end of the recording paper, the pulse motor 22 is rotated in a reverse direction to rotate the drums 10 and the pulley holders 15 counterclockwise, thus enabling the paper supply operation to proceed to the printing operation without interruption. Furthermore, slantwise feed of the recording paper 31 can be detected by monitoring the timing in which the two sensors 40 detect the trailing or leading end of the recording paper 31 during the paper feed or printing operation. In case such slantwise feed of the recording paper 31 is detected during the paper feed operation, the pulse motor 22 is not reversed in rotation so that the drums 10 are made to continue clockwise rotation, by means of which the recording paper 31 is automatically taken off to make recovery operation simplified. Moreover, such accidents as jamming, tearing and comming-off of the recording paper 31 or accidents of rotation of the drums 10 and the pulse motor 22 can be detected by monitoring a period of time during which the sensors 40 detect the recording paper 31 in printing, that is, the output of the sensors 40 corresponds to a logical value 1, or a period in which the sensors 40 detect the leading or trailing end of the recording paper 31.

The belt 17 is generally in contact with the drum 10 except for an open portion 10*a* which is part of the drum 10, as shown in FIG. 2. The paper feed guides 41 and 42 are disposed adjacent the lower area of the open portion 10*a*, and the paper delivery guide 43 is disposed adjacent the upper area of the open portion 10*a*. In an recording cycle, positioning of the open portion 10*a* relative to the automatic paper feed and delivery mechanism is conducted when the drums 10 and the pulley holders 15 are rotated counterclockwise as viewed in FIG. 2. More specifically, when a detectable means (not shown), such as a slit, a magnet or a conductive foil, mounted on the puller holder 15, is detected by a sensor (not shown), the pulse motor 22 is stopped and the open portion 10*a* is thus positioned relative to the automatic paper feed and delivery mechanism.

FIG. 3 shows a sequence of operations in which the rotational angle of the cylindrical shaft 9 securedly mounting the drum 10 thereon is detected by the rotary encoder 27, and in which the thermal head 2 conducts recording on the basis of the detected rotational angle. The speed, at which the pulse motor 22 rotates the recording medium winding rotary body, consisting of the platen roll 1 and the pair of drums 10, through the gear train, is controlled by a central processing unit 36 of a microcomputer (hereinafter referred to as an "MPU") through a driver 34. More specifically, a counter 39 counts the number of signals output from the rotary encoder 27 and sends a signal to the MPU 36 when the number of pulses reaches a predetermined value. Upon receipt of the signal, the MPU 36 drives a driver 38 and thereby energizes the thermal head 2 for recording. An image information stored in an image memory (line memory) 35 and an image quality information stored in an image quality information ROM 37 are given to the MPU 36, which in turn sends them to a line buffer of the thermal head 2 as data corresponding to one line.

The recording paper feed and delivery process will now be described in brief.

When the pickup roll 45 is driven, the sheet of recording paper 31 placed on top of the pile of recording paper 31 accommodated in the paper cassette 31 is picked up and sent to enter between the upper and lower guides 41 and 42. In a timing in which the leading end of the sheet of recording paper reaches the vicinity of the drums 10, i.e., a predetermined period of time after rotation of the pickup roll 45 has started, the pulse motor 22 is driven to rotate the drums 10 and the belts 17 clockwise. As a result, the sheet of recording paper 31 is inserted between the drums 10 and the belts 17 and then fed with the two edges thereof gripped between the drums 10 and the belts 17.

Once the trailing end of the recording paper 31 is detected by the sensors 40, direction of the rotation of the pulse motor 22 is reversed by the detection signal of the sensors 40 to rotate the cylindrical shafts 9 on which the drums 10 are fitted in a direction opposite to that in which they are rotated when the recording paper is fed and thereby to rotate the platen roll 1 through the gears 11 fitted on the cylindrical shafts 9 and located within the drums 10, the intermediate gears 12 and the gears 13 in the same direction and at the same peripheral speed as that in which the drums 10 arc rotated while the recording is conducted by the thermal head 2 in a recording timing. At that time, the pulley holders 15 rotate together with the drums 10 since the one-way clutches 14 provided on the bosses thereof are locked. That is, the pulley holders 15 rotate with the belts 17 pressing the recording paper 31 on the outer peripheral surfaces of the drums 10. At that time, the thermal head 1 is at its lower position to conduct recording on the recording paper 31 in the color of an ink ribbon (not shown), e.g., in yellow. During the recording, the pulse motor 22 is rotated at a speed about one fourth that at which it is driven during the paper feed operation.

Once the leading end of the recording paper 31 passes between the thermal head 2 and the platen roll 1, recording in a first color is completed. Until the trailing end of the recording paper 31 reaches the thermal head 1, the ink ribbon in a second color, e.g., cyan, is controlled to reach the thermal head 1. Recording in three colors, including yellow, cyan and magenta, or in four colors, including yellow, cyan, magenta and black, is thus conducted. That is, recording is completed while the recording paper 31 makes three or four revolutions. As described above, recording is conducted without requiring the reciprocating movements of the reocrding paper, so that color mis-alignment can be eliminated and recording of high quality can be obtained. Presence or absence of the recording data may be monitored so that completion of recording in each color can be detected upon the absence of the data.

After the recording in three or four colors is completed, counterclockwise rotation of the drums 10 and the pulley holders 15 continues until the drums 10 and the pulley holders 15 come to the position shown in FIG. 2, i.e., rotation continues until the detectable means on the pulley holder 15 is detected, as described above. Once the detectable means is detected and the drums 10 and the pulley holders 15 are located at the position shown in FIG. 2, the pulse motor 22 is reversed again to rotate the drums 10 and the belts 17 clockwise, thereby delivering the recording paper through the upper area of the open portion 10*a* onto the paper delivery guide 43.

In this embodiment, the transition from the paper feed operation to the recording operation and from the recording operation to the paper delivery operation can be made without delay, so that recording speed can be increased. Furthermore, the drums 10 are rotated in the same direction during the paper feed and delivery operations, so that if failure in feed of paper occurs, e.g., the recording paper is slantwise fed, the recording paper can be readily taken off, thus facilitating recovery operation. Moreover, whether only the drums 10 are rotated or the drums 10 and the pulley holders 15 are rotated together is determined by the switchover of rotational direction of the pulse motor 22, so that the respective operations can be readily selected and be automated to further increase the speed of recording. Furthermore, the outer peripheral surface of the platen roll is slightly higher than the outer peripheral surfaces of the drums, and the platen roll 1 is compressed to be flush with the drums 10 when the thermal head 2 is pressed against the platen roll 1. In consequence, the portions of the recording paper which are held between the drums 10 and the belts 17 are substantially aligned with that of the recording paper which is disposed between the two drums 10, i.e., which is interposed between the thermal head 2 and the platen roll 1. As a result, deformation or folding of the recording paper, which would adversely affect paper feeding and recording quality, can be substantially eliminated.

Figure 5:
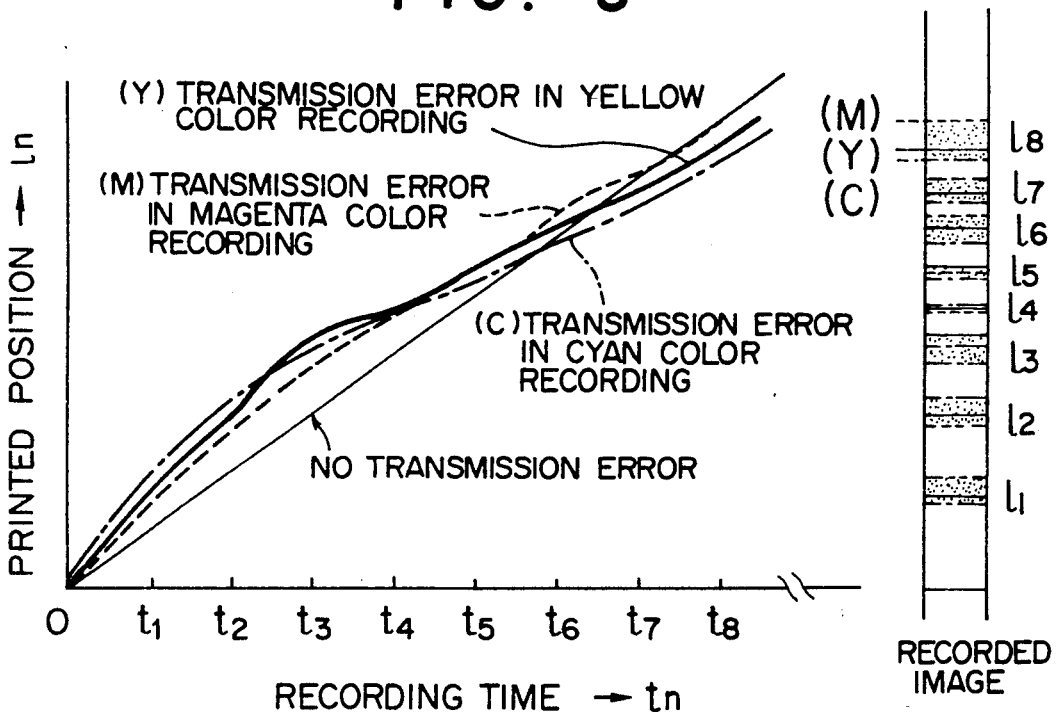
FIG. 5 is a graph showing mis-alignment of three colors in printing conducted by a conventional thermal printer.

FIG. 5 shows the results of estimation of non-alignment of color produced when the gear train having the conventional numbers of teeth is used. In FIG. 5, the abscissa represents recording time, and the ordinate represents printed position. Zero transmission error is indicated by a linear solid line, the transmission error produced during the yellow (Y) recording is indicated by solid line, the transmission error produced during the magenta (M) recording is indicated by chain line, and the transmission error produced during the cyan (C) recording are indicated by dot and dash line.

As shown by the three curves, the transmission errors do not exhibit reproducibility. This means that non-alignment of three colors occurs, i.e., unevenness of color is generated, over the three color recording periods.

Figure 6:
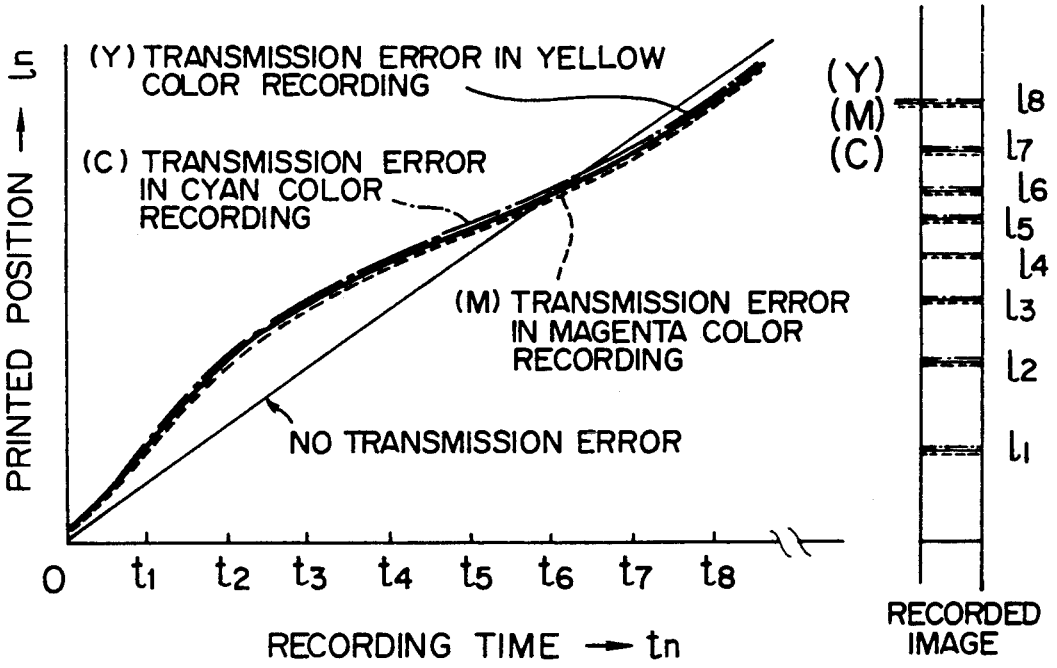
FIG. 6 is a graph showing mis-alignment of three colors in printing conducted by the thermal printer according to the present invention.

FIG. 6 shows the result obtained when the gear train having numbers of teeth according to the present embodiment is used. The graphic presentation of FIG. 6 is drawn in the same manner as that of FIG. 5.

As shown in FIG. 6, although the transmission errors cannot be reduced, mis-alignment of three colors, i.e., unevenness of color, does not occur since the three curves for Y, M and C almost correspond to one another.

That is, unevenness of colors can be eliminated during the recording in three colors, including yellow (Y), magenta (M) and cyan (C), by employing five transmission gears each having a number of teeth which enables it to make an integral number of revolutions in the recording period of a single color, i.e., by employing the gear 25 fixed to the shaft 26 of the rotary encoder (a number of teeth of 28), the gear 18 fixed to the cylindrical shaft 9 (a number of teeth of 112), the gears 11 fixed to the drum shaft (a number of teeth of 90), the gears 12 fixed to the idler shafts (a number of teeth of 30), and the gears fixed to the shafts of the platen roll (a number of teeth of 18).

In this embodiment, since the number of teeth of each gear in the gear train is set to a value which enables the gear to make an integral number of revolutions in the recording period of a single color, unevenness of colors in the recording in three colors can be eliminated. This technique is simpler and easier than the technique of absolutely increasing the transmission accuracy of the gears, and is hence inexpensive.

Figure 4:
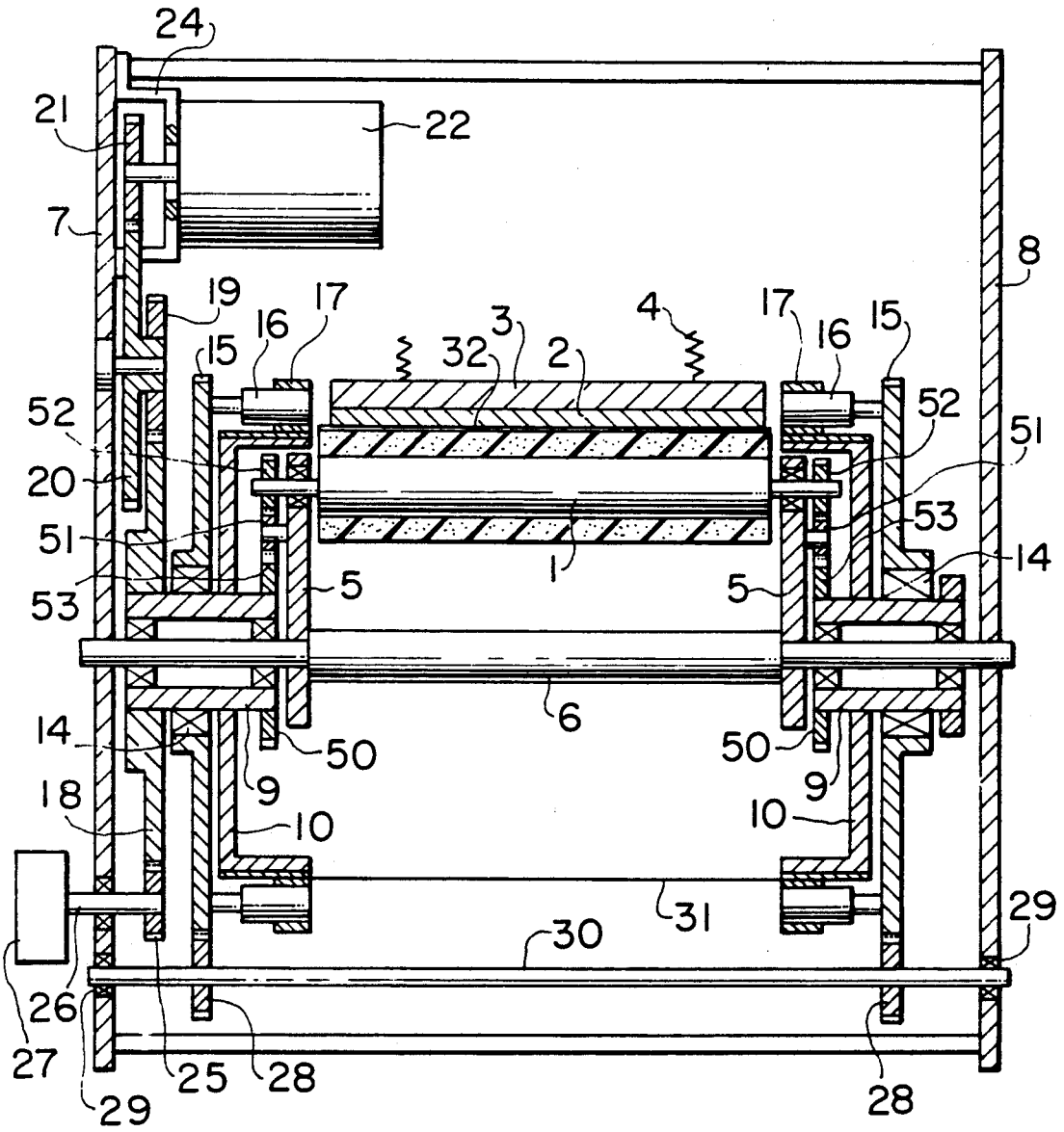
FIG. 4 is a cross-sectional view of a thermal printer according to a second embodiment of the present invention.

FIG. 4 shows a second embodiment which employs toothed pulleys and toothed belts as part of the driving force transmission mechanism. In the second embodiment, the overall configuration and the transmission mechanism from the pulse motor 22 to the gear 18 fixed to the end portion of the cylindrical shaft 9 on which the drum 10 is fitted are the same as those of the first embodiment, and the structure which is different from that of the first embodiment will be detailed below.

A toothed pulley 50 fitted on the end portion of the cylindrical shaft 9 located within the drum 10 drives a toothed pulley 52 fitted on a shaft of the platen roll 1 through a toothed belt 53. Tension of the toothed belt 53 is adjusted by a toothed idler pulley 51. Another toothed pulley 52 is fitted on the other end of the platen roll shaft, and drives another toothed pulley 50 fitted on the cylindrical shaft 9 through another toothed belt 53. The number of teeth of the toothed pulley 50 is 90, that of the toothed pulley 52 is 18, and that of the toothed belt 53 is 90. The diameter of the platen roll is 34 $\phi$, and the diameter of the drum is 170 $\phi$. In the recording period of a single color, the drum 10 make one revolution, the platen roll 1 makes five revolutions, and the toothed belt 53 makes one revolution. Each of the toothed pulleys and each of the toothed belts make an integral number of revolutions in the recording period, and, hence, unevenness of feed caused due to the transmission errors exhibits reproducibility. Recording is conducted on the basis of the detection signal from the encoder 27 in the same timing as that of the first embodiment.

As will be understood from the foregoing description, according to the present invention, although the transmission accuracy of each gear in the driving gear train is not particularly improved, non-alignment of a plurality of colors can be eliminated, i.e., unevenness of color cannot be generated, in a thermal printer in which inks of the plurality of colors are placed one on another for recording while the recording medium is being rotated in one direction.

Furthermore, according to the present invention, recording speed can be increased. Also, transition between the paper feed operation, the recording operation and the paper delivery operation can be automated and the configuration therefor can be simplified.

What is claimed is:

1. In a thermal printer including a platen roll axially extending in opposed relationship with a line-type thermal head, two drums provided on the axially opposite sides of the platen roll, at least one of which drums is adapted to be driven by a motor, two pulley holders provided axially outwardly of the drums, a plurality of belt supporting pulleys provided in the circumferential direction of the drums at predetermined intervals and supported on pulley shafts mounted on the pulley holders, and endless belt means adapted to be guided by the pulleys such that the inner side of the belt means is in close contact with a portion of the outer periphery of the drums, the drums being adapted to be rotated and the belt means being adapted to be rotatingly driven by the drums so that the drums and the belt means interpose therebetween opposite lateral edges of the sheet of paper, and the drums and the pulley holders are rotated together during the printing operation to move the sheet of paper in one direction while said thermal head and said platen roll cooperate to conduct printing on the sheet of paper, the improvement wherein the pulley holders are mounted on the drum shafts through one-way clutches which act to change the rotational direction of the motor during the paper feed and delivery operations and during the printing operation such that only the drums are rotated during the paper feed and delivery operations and the drums and the pulley holders are rotated together during the printing operation.

2. A thermal printer according to claim 1, further comprising gears mounted on the opposite ends of a platen roll shaft on which said platen roll is mounted, said gears being adapted to be in mesh with gears mounted on said two drums, thereby driving the other drum through said platen roll shaft.

3. A thermal printer according to claim 1, wherein said pulley holders are provided at the outer periphery thereof with gear teeth which are adapted to be in mesh with two gears mounted on a rotary shaft, thereby making rotational phases of said two pulley holders corresponding with each other.

4. A thermal printer according to claim 1, wherein the opposite ends of said rotary shaft on which said two gears are mounted are supported by stationary frames through one-way clutches.

5. A thermal printer according to claim 1, wherein the circumferential length of said drums is larger than the longest sheet of paper that can be printed.

6. A thermal printer according to claims 1 or 5, further comprising sensors provided in the vicinity of a travel path of the sheet of paper on the opposite widthwise ends of the sheet of paper for detecting presence or absence of the sheet of paper to monitor points of time when the opposite widthwise edges of the sheet of paper pass by said sensors, thereby detecting accidents in the travelling of the sheet of paper.

7. A thermal printer according to claim 1 or 5, further comprising a sensor provided in the vicinity of a travel path of the sheet of paper for detecting presence or absence of the sheet of paper to monitor points of time when the leading or trailing end of the sheet of paper makes one revolution, thereby detecting accidents in the travelling of the sheet of paper.

8. A color thermal printer according to claim 1, further comprising two gear trains adapted to mesh with gears mounted on said two drums and adapted to mesh with gears mounted on opposite ends of shaft upon which the platen roll is mounted, and wherein the number of teeth of said gears mounted on said drums is an integral of the number of teeth of the respective gears constituting said gear trains and number of teeth of said gears mounted on said shaft of said platen roll.

9. A color thermal printer according to claim 8, further comprising a rotating angle detecting means provided on an end of a rotating shaft mounted thereon a gear adapted to mesh with a gear mounted on a rotating shaft of at least one of said two drums, and wherein a ratio of a number of teeth of said gears mounted on said drums and a number of teeth of said gear mounted on the shaft of said rotated angle detecting means is an integral number.

10. A color thermal printer according to claim 8, further comprising a gear mounted on a rotating shaft of at least one of said two drums, a gear train adapted to mesh with said gear mounted on said rotating shaft and a motor shaft which mounts thereon a gear adapted to mesh with said gear train, and wherein a ratio of a number of teeth of said gear mounted on said drum and a number of teeth of said gear mounted on said motor shaft is an integral number.

11. A color thermal printer according to claim 8, wherein a ratio of an inner diameter of portions of said drums contacting said platen roll and an outer diameter of said platen roll is an integral number.

12. In a thermal printer including a platen roll axially extending in opposed relationship with a line-type thermal head, two drums providing on the axially opposite sides of the platen roll, at least one of which drums is adapted to be driven by a motor, two pulley holders provided axially outwardly of the drums, a plurality of belt supporting pulleys provided in the circumferential direction of the drums at predetermined intervals and supported on pulley shafts mounted on the pulley holders, and endless belt means adapted to be guided by the pulleys such that the inner side of the belt means is in close contact with a portion of the outer periphery of the drums, the drums being adapted to be rotated and the belt means being adapted to be rotatingly driven by the drums so that the drums and the belt means interpose therebetween opposite lateral edges of the sheet of paper and the drums and the pulley holders are rotated together during the printing operation to move the sheet of paper in one direction while said thermal head and said platen roll cooperate to conduct printing on the sheet of paper, the improvement wherein the surface of said platen roll in uncompressed condition objects slightly outwardly beyond the surface of said drums.

13. A method of feeding and delivering a sheet of paper in a thermal printer including a platen roll axially extending in opposed relationship with a line-type thermal head, two drums provided on the axially opposite sides of the platen roll, two pulley holders provided axially outwardly of the drums, a plurality of belt supporting pulleys provided in the circumferential direction of the drums at predetermined intervals and supported on pulley shafts mounted on the pulley holders, and endless belt means adapted to be guided by the pulleys such that the inner side of the belt means is in close contact with a portion of the outer periphery of the drums, the drums and the belt means being adapted to interpose therebetween opposite lateral edges of the sheet of paper and being rotated together to move the sheet of paper in one direction while said thermal head and said platen roll cooperate to conduct printing on the sheet of paper, said method comprising the steps of: during the feeding of the sheet of paper, positioning a lower portion of an opened portion of said drums at a feed inlet for the sheet of paper, which opened portion is not in close contact with the belt means; inserting the sheet of paper into the lower portion of an opened portion while rotating the drums and the belt means; and during the delivery of the sheet of paper, positioning an upper portion of the opened portion of the drums at a delivery outlet while rotating the drums and the belt means in the same direction as during the feeding of the sheet of paper and delivering the sheet of paper from the upper portion of the opened portion of the drums.

14. A method of printing in a thermal printer including a platen roll axially extending in opposed relationship with a line-type thermal head, two drums provided on the axially opposite sides of the platen roll, at least one of which drums is adapted to be driven by a motor, two pulley holders provided axially outwardly of the drums, a plurality of belt supporting pulleys provided in the circumferential direction of the drums at predetermined intervals and supported on pulley shafts mounted on the pulley holders, and endless belt means adapted to be guided by the pulleys such that the inner side of the belt means is in close contact with a portion of the outer periphery of the drums, the drums being adapted to be rotated and the belt means being adapted to be rotatingly driven by the drums so that the drums and the belt means interpose therebetween opposite lateral edges of the sheet of paper and the drums and the pulley holders are rotated together during the printing operation to move the sheet of paper in one direction while said thermal head and said platen roll cooperate to conduct printing on the sheet of paper, said method comprising the steps of: during the feeding of the sheet of paper, rotating the drums and the pulley holders together after the trailing end of the sheet of paper is detected by sensor means provided in the vicinity of a feed inlet of the drums, into which the sheet of paper is fed; and reversing the rotational direction of the drums for the printing operation.

* * * * *